US008615099B2

(12) United States Patent
Chang et al.

(10) Patent No.: US 8,615,099 B2
(45) Date of Patent: Dec. 24, 2013

(54) TRANSPARENT SPEAKER AND DISPLAY MODULE INTEGRATING THE SAME

(75) Inventors: You-Chia Chang, Taichung (TW); Jyi-Tyan Yeh, Hsinchu County (TW); Chun-Ti Chen, Hsinchu (TW); Shur-Fen Liu, Hsinchu County (TW); Jyh-Long Jeng, Taipei County (TW); Dar-Ming Chiang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 731 days.

(21) Appl. No.: 12/832,753

(22) Filed: Jul. 8, 2010

(65) Prior Publication Data

US 2011/0033074 A1 Feb. 10, 2011

(30) Foreign Application Priority Data

Aug. 5, 2009 (TW) ..... 98126450 A
Jan. 15, 2010 (TW) ..... 99101127 A

(51) Int. Cl.
*H04R 1/02* (2006.01)

(52) U.S. Cl.
USPC ..... 381/388

(58) Field of Classification Search
USPC ..... 381/388, 306, 333
See application file for complete search history.

(56) References Cited

U.S. PATENT DOCUMENTS

| | | | | |
|---|---|---|---|---|
| 6,199,655 | B1 * | 3/2001 | Norris | 181/173 |
| 6,427,017 | B1 * | 7/2002 | Toki | 381/190 |
| 6,925,191 | B2 | 8/2005 | Petroff et al. | |
| 7,050,600 | B2 | 5/2006 | Saiki et al. | |
| 2003/0002697 | A1 | 1/2003 | Mellow | |

FOREIGN PATENT DOCUMENTS

CN 101040561 A 9/2007

OTHER PUBLICATIONS

Kim et al., Color moire pattern simulation and analysis in three-dimensional integral imaging for finding the moire-reduced tilted angle of a lens array, Apr. 8, 2009, Applied Optics, vol. 48, Issue 11, pp. 2178-2187.*

State Intellectural Property Office of the People's Republic of China, "Office Action", Jan. 22, 2013, China.

* cited by examiner

*Primary Examiner* — Curtis Kuntz
*Assistant Examiner* — David J Ho
(74) *Attorney, Agent, or Firm* — Morris Manning & Martin, LLP; Tim Tingkang Xia, Esq.

(57) ABSTRACT

A transparent speaker is suitable for being disposed on a display panel. The transparent speaker includes a transparent membrane, a transparent electrode plate, and spacers. Each transparent electrode plate has a plurality of openings. The display panel includes a plurality of pixels. The pixels emit optical signals. A Moire spatial period of the optical signals is less than 600 μm after the optical signals pass through the transparent speaker. When the transparent speaker is disposed on the display panel, a user is able to watch an image on the display panel through the transparent speaker without being interfered by a Moire.

18 Claims, 8 Drawing Sheets

TRANSPARENT SPEAKER AND DISPLAY MODULE INTEGRATING THE SAME

CROSS-REFERENCE TO RELATED APPLICATIONS

This non-provisional application claims priority under 35 U.S.C. §119(a) on Patent Application No. 098126450 filed in Taiwan, R.O.C. on Aug. 5, 2009, and Patent Application No. 099101127 filed in Taiwan, R.O.C. on Jan. 15, 2010, the entire contents of which are hereby incorporated by reference.

BACKGROUND

1. Field of Invention

The present invention relates to a speaker and a display device with the same, and more particularly to a transparent speaker and a display device with the same.

2. Related Art

Usually, a larger speaker has a better tone quality. However, a notebook or handheld mobile device has limited room for accommodating a speaker. Therefore, it is not easy for the speaker embedded in the notebook or handheld mobile device to have a good sound quality. Also, in the notebook or handheld mobile device, a display panel occupies a large proportion of room. If a transparent speaker which is able to be placed in front of a display panel may be developed, the room of the notebook or handheld mobile device may be utilized more effectively. In other words, in a design that a display panel and a transparent speaker with a larger size may be disposed on a notebook or handheld mobile device, the notebook or handheld mobile device may satisfy the demands on both a panel size and a tone quality at the same time. Moreover, in such a design, as a transparent speaker is disposed at a display panel, sound and images may appear at the same position, so the design is more intuitive for the user.

In the U.S. Pat. No. 7,050,600 B2 entitled SPEAKER SYSTEM, MOBILE TERMINAL DEVICE, AND ELECTRONIC DEVICE, a transparent speaker technology applicable in a display panel is disclosed. In this application, a membrane of a speaker is disposed at an outmost layer and directly contacts with air. However, when the membrane of the speaker directly contacts with the ambient air, the sound of the speaker is easily affected and the membrane of the speaker is easily damaged.

In addition, in the U.S. Pat. No. 6,199,655 B1 entitled HOLOGRAPHIC TRANSPARENT SPEAKER, a transparent speaker is proposed. However, when the transparent speaker is disposed on a liquid crystal display panel, a Moire phenomenon easily occurs.

SUMMARY

In view of the above problems, the present invention is a transparent speaker and a display device with the same, such that the sound of a speaker and visual performance of a display panel are able to be improved when the speaker and a display panel are used together.

The present invention provides a transparent speaker suitable for being disposed on a display panel. The transparent speaker comprises a transparent membrane, at least one transparent electrode plate, and a plurality of spacers. Each transparent electrode plate has a plurality of openings and two surfaces opposite to each other. These openings penetrate the transparent electrode plate from one surface of the transparent electrode plate to the other surface thereof. These spacers are disposed between the transparent membrane and the transparent electrode plate. The display panel comprises a plurality of pixels. The pixels emit optical signals. A Moire spatial period of the optical signals is less than 600 μm an after the optical signals pass through the transparent speaker.

In the transparent speaker of the present invention, a transparent electrode plate has a planar two-dimensional graphic. The planar two-dimensional graphic is a function f described through a rectangular coordinate. The rectangular coordinate comprises an X-axis and a Y-axis perpendicular to each other. A value of the function f(x,y) at a position of a opening is 0 and a value of the function f(x,y) at a position of a non-opening is 1. The function f(x,y) can be Fourier transformed into $F(s_x,s_y)$, that is, $$F(s_x, s_Y) = \int_{-\infty}^{\infty}\int_{-\infty}^{\infty} f(x, y)e^{-2\pi i(s_x x + s_y y)}dxdy$$

After Fourier transform, for any point $(c_x,c_y)$ located within $$\left(s_x - m\times\frac{1}{P_X}\right)^2 + \left(s_Y - n\times\frac{1}{P_Y}\right)^2 < \left(\frac{1}{600um}\right)^2 \text{ and,}$$

$$|s_x| > \frac{1}{W_x},\quad |s_Y| > \frac{1}{W_Y}$$

the Fourier transformed function F has to satisfy the following expression:

$$\frac{\int_{c_X-\frac{1}{2W_X}}^{c_X+\frac{1}{2W_X}}\int_{c_Y-\frac{1}{2W_Y}}^{c_Y+\frac{1}{2W_Y}}|F(s_x, s_y)|^2 ds_x ds_Y}{\int_{-\infty}^{\infty}\int_{-\infty}^{\infty}|F(s_x, s_y)|^2 ds_x ds_Y} < 0.01$$

The $W_X$ and $W_Y$ are lengths of the planar two-dimensional graphic on the X-axis and the Y-axis. The m and n can be either −1, 0 or +1. The $P_X$ is a spatial period of a plurality of pixels of the display panel on the X-axis. The $P_Y$ is a spatial period of the plurality of pixels of the display panel on the Y-axis.

The present invention further provides a display module with a transparent speaker, which comprises a transparent speaker and a display panel. A structure of the transparent speaker is the same as a structure of the above-mentioned transparent speaker. The transparent speaker is disposed on the display panel.

In view of the above, when the transparent speaker and the display panel are overlapped, the transparent speaker may avoid a low-spatial-frequency Moire, thereby further improving a visual performance when the transparent speaker and the display panel are combined.

BRIEF DESCRIPTION OF THE DRAWINGS

The present invention will become more fully understood from the detailed description given herein below for illustration only, and thus are not limitative of the present invention, and wherein.

DETAILED DESCRIPTION

Detailed features and advantages of the present invention are illustrated in detail in the detailed description below, the contents of which are sufficient for any person skilled in the art to understand and implement the technical contents of the present invention technology. According to the contents, claims and accompanying drawings disclosed in the specification, any person skilled in the art may easily understand objectives and advantages related to the present invention. The following embodiments are intended to further illustrate the viewpoints of the present invention in detail, rather than to limit the scope of the present invention with any viewpoints.

In order to make the contents disclosed in the specification more clear, before the detailed description, a spatial period and a spatial frequency of a periodic pattern are first defined. A spatial period of a periodic pattern that consists of a group of stripes is defined as a distance between a darkest part and an adjacent darkest part of the stripes. As human eyes have limited resolution, when the spatial period becomes larger, human eyes observe alternately bright and dark stripes more easily. Usually when the spatial period of the stripes is greater than 600 μm, human eyes may clearly see the stripes. A spatial frequency of the stripes is defined as an inverse of the spatial period. If the spatial period is 600 μm, the spatial frequency is $1/600\ \mu m^{-1}$. According to a Fourier transform theorem, an arbitrary graphic may be divided into superposition of a plurality of periodic pattern having different spatial periods. Therefore, the foregoing definitions are not only applicable for periodic pattern, but also for various graphics.

Figure 1:
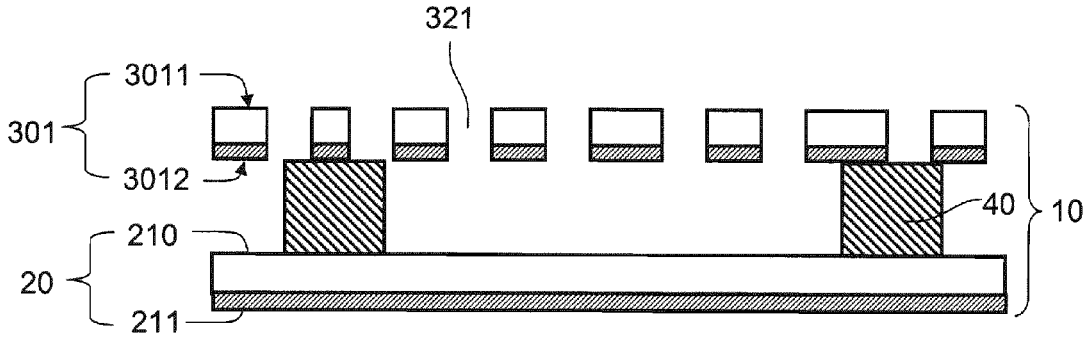
FIG. 1 is a schematic sectional view of a signal-layer electrode-plate transparent speaker according to the present invention.

FIG. 1 is a schematic sectional view of a signal-layer electrode-plate transparent speaker according to the present invention. The signal-layer electrode-plate transparent speaker 10 comprises a transparent membrane 20, a first transparent electrode plate 301, a second transparent electrode plate 302, and a plurality of spacers 40. The spacers 40 are used for fixing the transparent membrane 20 between the first transparent electrode plate 301 and the second transparent electrode plate 302.

In this embodiment, in order to make the speaker transparent, the transparent membrane 20 is a transparent electret membrane. The transparent membrane 20 comprises a membrane body 210 and a transparent membrane conductive layer 211. The transparent membrane conductive layer 211 is located on a surface of the membrane body 210.

The first transparent electrode plate 301 comprises a electrode body 3011 and a electrode conductive layer 3012. As can be seen in the FIG. 1, the conductive layer 3012 is disposed between the electrode body 3011 and the electrode transparent membrane 20. Besides the structure shown in the FIG. 1, the electrode body 3011 also can be disposed between the electrode conductive layer 3012 and the electrode transparent membrane 20.

Figure 2:
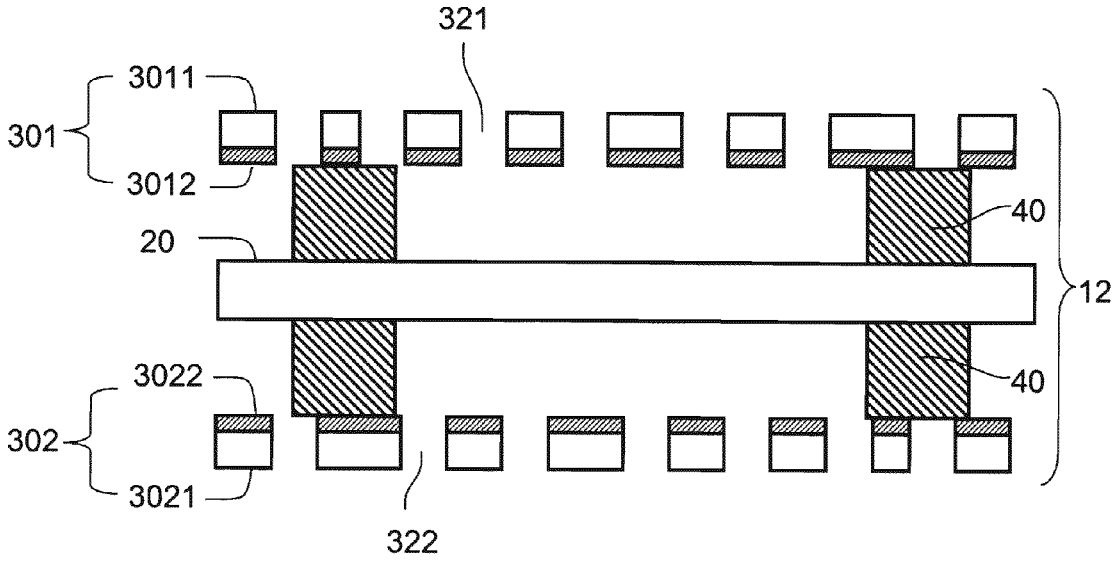
FIG. 2 is a schematic sectional view of a double-layer electrode-plate transparent speaker according to the present invention.

Besides the signal-layer structure described above, the invention also provides a double-layer structure. FIG. 2 is a schematic sectional view of a double-layer electrode-plate transparent speaker according to the present invention. The double-layer electrode-plate transparent speaker 12 comprises a transparent membrane 20, a first transparent electrode plate 301, a second transparent electrode plate 302, and a plurality of spacers 40. A transparent membrane 20 is disposed between the first transparent electrode plate 301 and the second transparent electrode plate 302. The spacers 40 are used for fixing the transparent membrane 20 between the first transparent electrode plate 301 and the second transparent electrode plate 302. The first transparent electrode plate 301 comprises a electrode body 3011 and a electrode conductive layer 3012. The electrode conductive layer 3012 is disposed between the electrode body 3011 and the transparent membrane 20. The second transparent electrode plate 302 comprises a electrode body 3021 and a electrode conductive layer 3022. The electrode conductive layer 3022 is disposed between the electrode body 3011 and the transparent membrane 20.

With exception of the structure described above, the electrode body 3011 also can be disposed between the conductive layer 3012 and the transparent membrane 20, and the electrode body 3021 also can be disposed between the conductive layer 3022 and the transparent membrane 20. That is to say, the structure of the first transparent electrode plate 301 and The first transparent electrode plate 302 is not the limitation of the invention.

In the two embodiments described above, the transparent conductive layer 211 is preferably made of aluminum zinc oxide (AZO) or indium tin oxide (ITO), or other transparent conductive materials, so as to achieve a conductive effect. The first transparent electrode plate 301 and the second transparent electrode plate 302 are made of a transparent polymer, glass, or other transparent materials.

If the first transparent electrode plate 301 and the second transparent electrode plate 302 totally enclose the transparent membrane 20 in a space, that is to say, if the transparent membrane 20 is unable to contact with the ambient air directly, sound waves generated by the transparent membrane 20 are unable to be effectively transmitted. Therefore, the first transparent electrode plate 301 has a first group of openings 321 and two surfaces 310 and 311 opposite to each other. The first group of openings 321 penetrates the first transparent electrode plate 301 from one surface 310 of the first transparent electrode plate 301 to the other surface 311 thereof. The second transparent electrode plate 302 also has a second group of openings 322 of similar structures. Based on the structures of the first group of openings 321 and the second group of openings 322, the sound waves generated by the transparent membrane 20 may effectively penetrate through the first transparent electrode plate 301 and the second transparent electrode plate 302.

Figure 3:
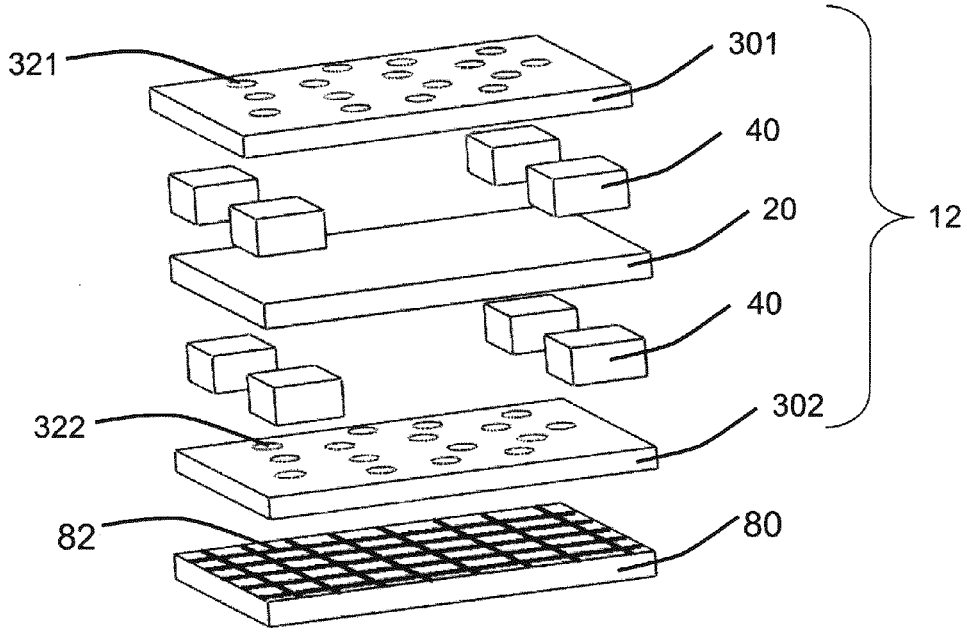
FIG. 3 is a schematic view of a structure of each layer of the double-layer electrode-plate transparent speaker and the display panel according to the present invention.

FIG. 3 is a schematic view of a structure of each layer of the double-layer electrode-plate transparent speaker 12 and the display panel 80 according to the present invention. A black matrix 82 of the display panel 80 defines pixels of the display panel 80.

Graphics of the first group of openings 321 and the second group of openings 322 need to be designed in cooperation with the black matrix 82 on the display panel 80, such that a Moire spatial period of optical signals is less than 600 μm after the optical signals pass through the double-layer electrode-plate transparent speaker 12.

Figure 4A:
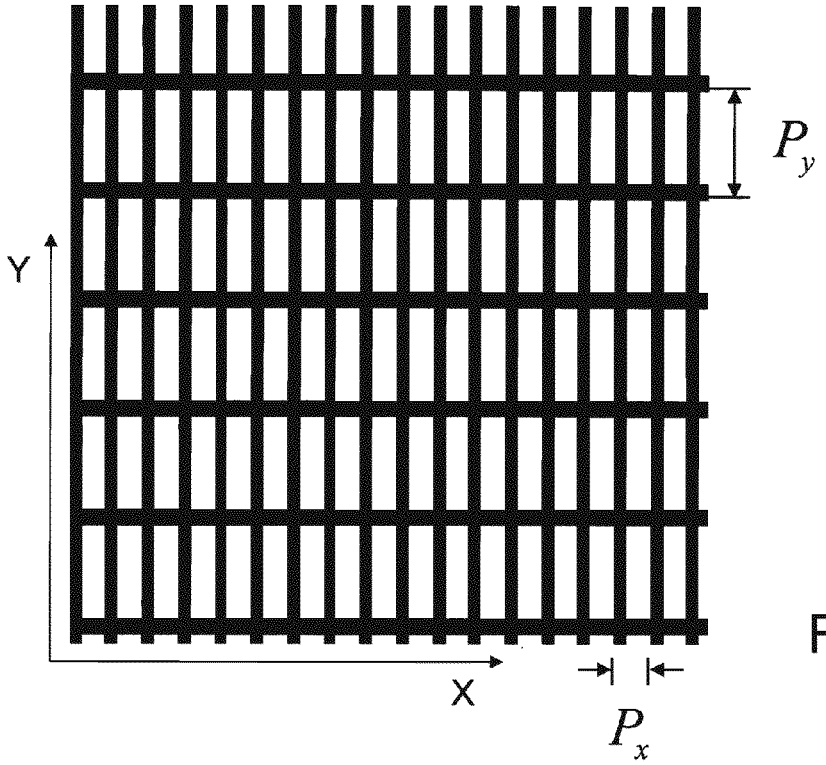
FIG. 4A is a schematic arrangement view of pixels of a display panel according to an embodiment of the present invention.
Figure 4B:
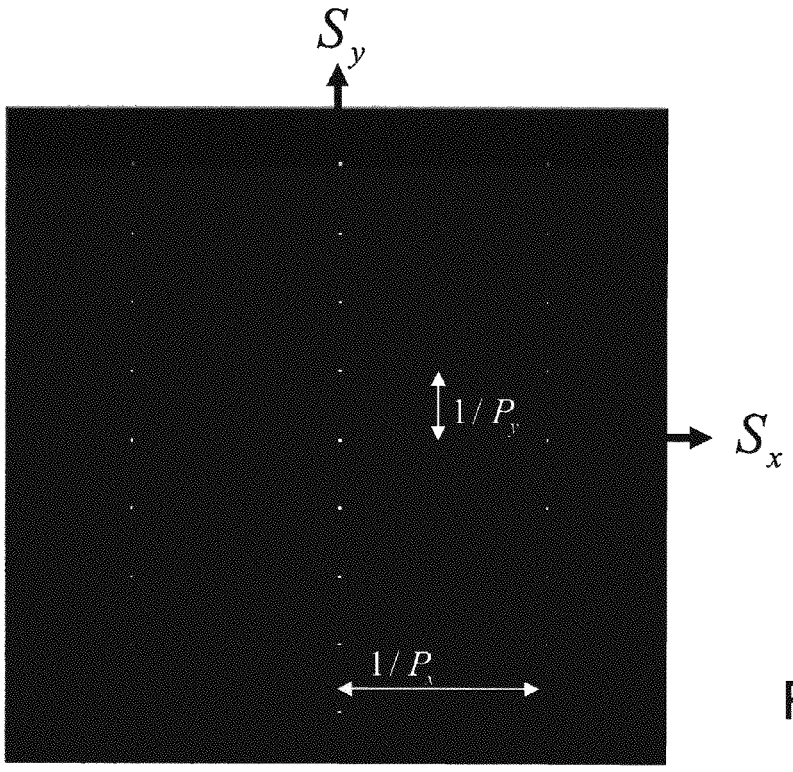
FIG. 4B is a spatial frequency spectrum view of pixel arrangement of a display panel according to an embodiment of the present invention.

Referring to FIGS. 4A and 4B, in FIG. 4A, positions of pixels are shown in white and positions of non-pixels are shown in black. The graphic may also be defined as a function $f_L$ through a rectangular coordinate. A function value at the position of the pixel (white position in FIG. 4A) is defined as 1; otherwise, the function value is defined as 0. The rectangular coordinate comprises an X-axis and a Y-axis perpendicular to each other. A spatial period of the pixels on an X-axis direction is $P_X$, and a spatial period of the pixels on a Y-axis direction is $P_Y$. The function $f_L$ may be represented by the following relations.

$f_L(x,y)=1$, if a point of a coordinate (x,y) is located at a pixel (white in FIG. 4A);

$f_L(x,y)=0$, if a point of the coordinate (x,y) is located at a non-pixel (black in FIG. 4A).

The function $f_L$ may be Fourier transformed into a function $F_L$. FIG. 4B is a graphic of the function $F_L$. As can be seen from FIG. 4B, spatial frequency components are concentrated at $(m/P_X, n/P_Y)$, and the m, n are integers.

When the transparent electrode plate overlaps the display panel, if a spatial frequency of the transparent electrode plate is close to a spatial frequency of the display panel, a low frequency Moire is generated. Therefore, the spatial frequency of the transparent electrode plate needs to avoid from appearing at position close to main spatial frequencies of the display panel, so as to avoid a low frequency Moire generated after overlapping.

Figure 5A:
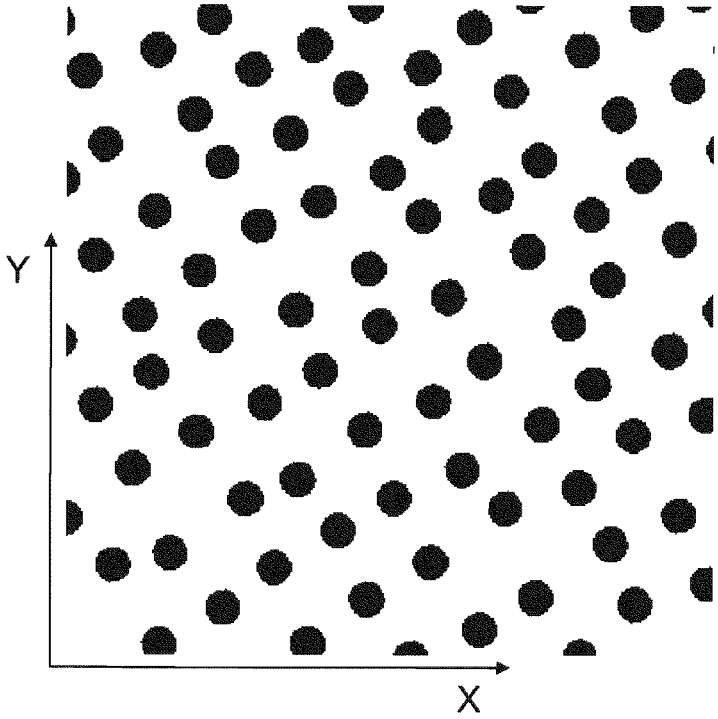
FIG. 5A is planar a planar two-dimensional graphic of an arrangement of the first group of openings of the first transparent electrode plate in FIG. 1.

FIG. 5A is a planar two-dimensional graphic of an arrangement of the first group of openings 321 of the first transparent electrode plate 301 in FIG. 1 or FIG. 2. Positions of the first group of openings 321 are shown in black and positions of non-openings are shown in white. The planar two-dimensional graphic is a function $f_{o(1)}$ described through a rectangular coordinate. The rectangular coordinate comprises an X-axis and a Y-axis perpendicular to each other. A planar two-dimensional graphic of the first transparent electrode plate 301 is a function $f_{o(1)}$ described through a rectangular coordinate. A value of the function $f_{o(1)}(x,y)$ at a position of a opening is 0. A value of the function $f_{o(1)}(x,y)$ at a position of a non-opening is 1. The function $f_o$ may be represented by the following relations:

$f_{o(1)}(x,y)=1$, if a point of a coordinate (x,y) is located at a non-opening (white in FIG. 5A);

$f_{o(1)}(x,y)=0$, if a point of a coordinate (x,y) is located at a opening (black in FIG. 5A).

Figure 5B:
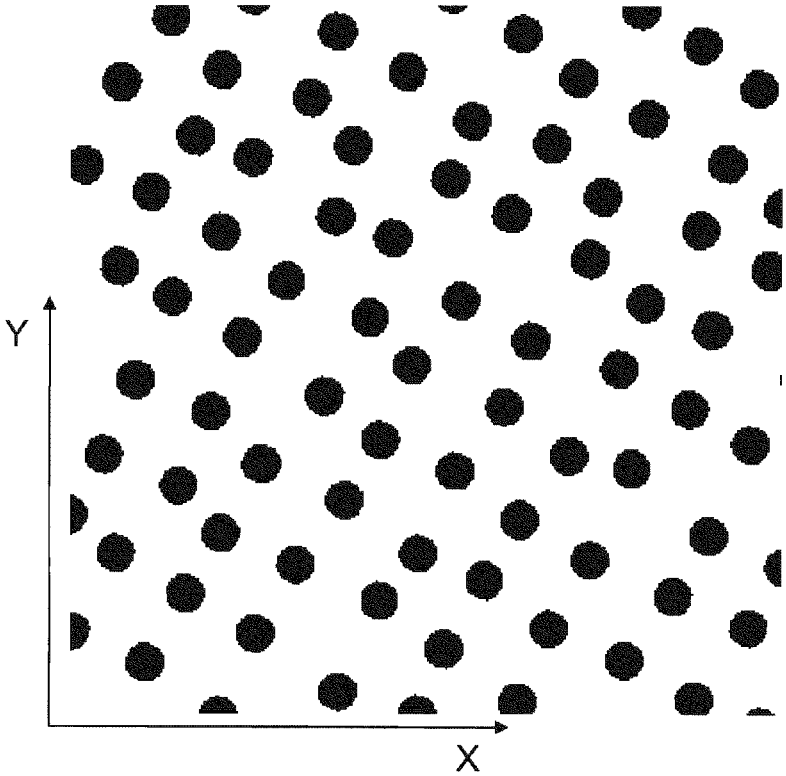
FIG. 5B is a planar two-dimensional planar graphic of an arrangement of a second group of openings of the second transparent electrode plate in FIG. 2.

FIG. 5B is a planar two-dimensional planar graphic of an arrangement of a second group of openings 322 of the second transparent electrode plate 302 in FIG. 2. Positions of the second group of openings 322 are shown in black and positions of the non-openings are shown in white. The function $f_{o(2)}(x,y)$ of the second group of openings 322 on the second transparent electrode plate 302 are defined in the same manner as the first transparent electrode plate 301. A total function $f_o(x,y)$ after the first transparent electrode plate 301 and the second transparent electrode plate 302 are overlapped is a result of multiplying a corresponding function of the first transparent electrode plate 301 by a corresponding function of the second transparent electrode plate 302. That is to say, $f_o(x,y)=f_{o(1)}(x,y)\times f_{o(2)}(x,y)$.

Figure 5C:
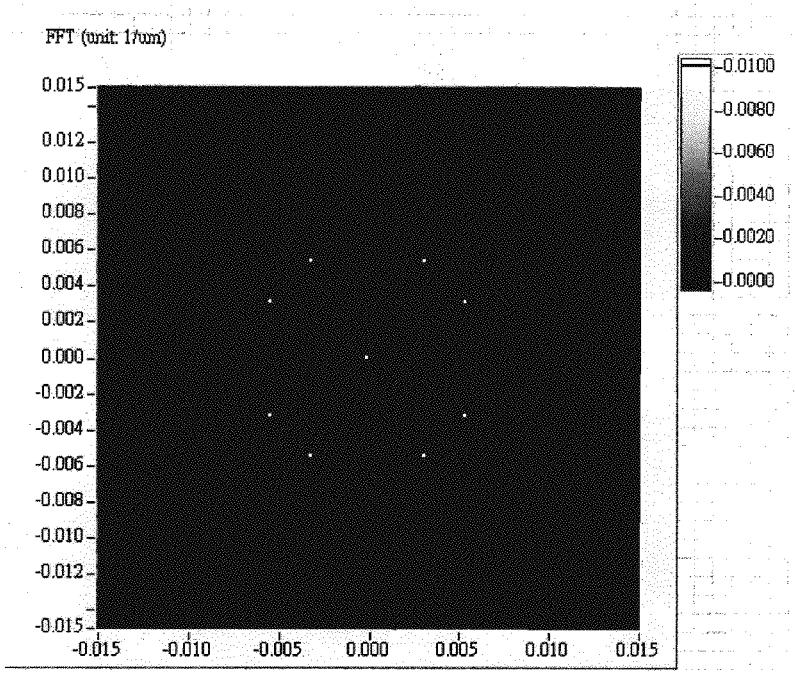
FIG. 5C is a spatial frequency spectrum view of openings of a transparent electrode plate according to an embodiment of the present invention.

A function $f_o$ is Fourier transformed to obtain a function $F_o$. FIG. 5C is a graphic of the function $F_o$. In order to avoid generating a Moire, positions where main spatial frequencies of the function $F_o$ appear need to avoid from being close to main spatial frequency components in the $F_L$. Therefore, a mathematic expression may be defined for the positions of the openings of the first transparent electrode plate 301 and the second transparent electrode plate 302. Such a mathematic expression is defined as follows.

For any point $(c_x,c_y)$ in the reference region, the function $F_o$ has to satisfy the following expression.

$$\frac{\int_{c_X-\frac{1}{2W_X}}^{c_X+\frac{1}{2W_X}}\int_{c_Y-\frac{1}{2W_Y}}^{c_Y+\frac{1}{2W_Y}}|F(s_x,s_y)|^2 ds_x ds_Y}{\int_{-\infty}^{\infty}\int_{-\infty}^{\infty}|F(s_x,s_y)|^2 ds_x ds_Y} < 0.01$$

The $W_X$ and $W_Y$ are lengths of the planar two-dimensional graphic on the X-axis and Y-axis.

Figure 5D:
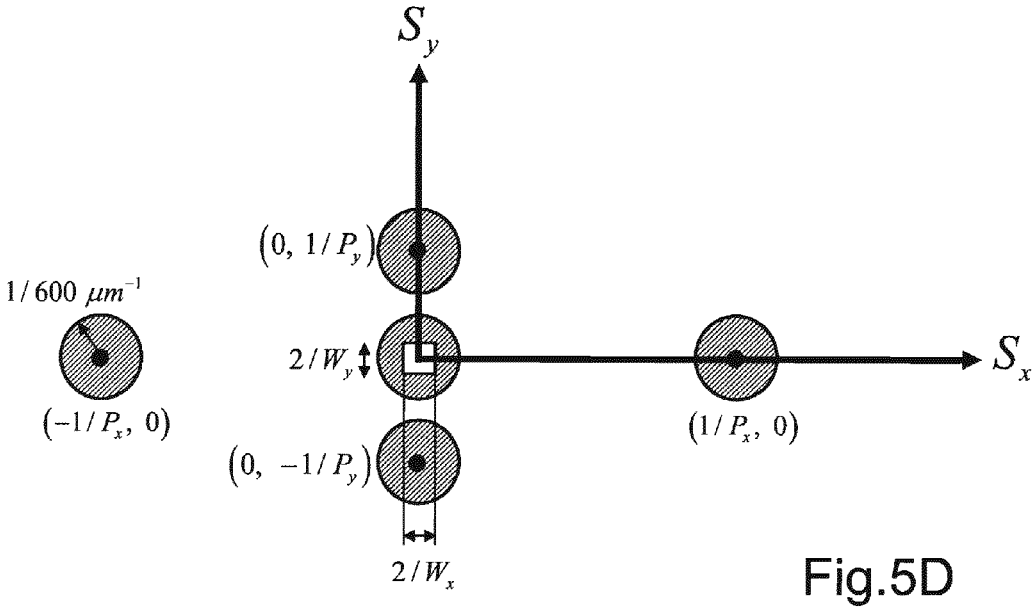
FIG. 5D is a reference region view of spatial frequencies of openings according to an embodiment of the present invention.

The reference region is $$\left(s_x - m\times\frac{1}{P_X}\right)^2 + \left(s_Y - n\times\frac{1}{P_Y}\right)^2 < \left(\frac{1}{600um}\right)^2 \text{ and}$$

$$|s_x| > \frac{1}{W_x},\quad |s_Y| > \frac{1}{W_Y},$$

and the m and n can be either −1, 0 or +1. Referring to FIG. 5D, the oblique line part is the reference region.

Figure 6:
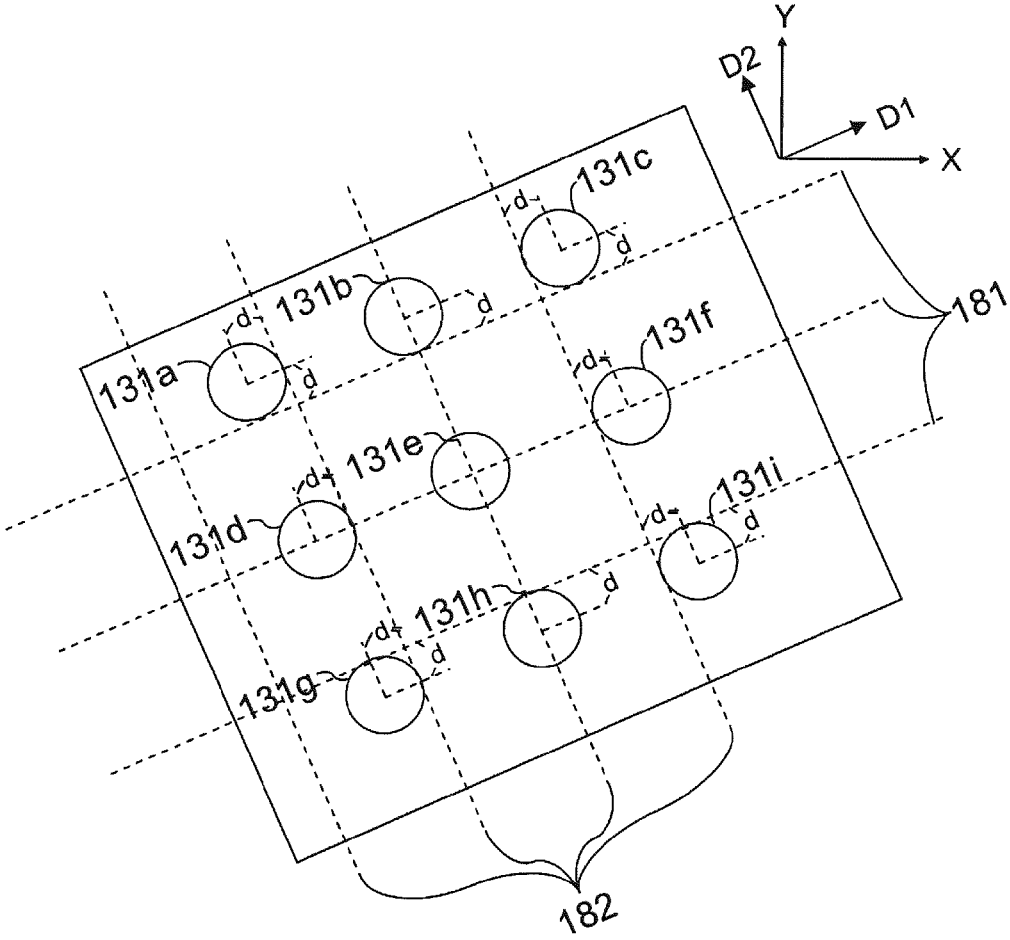
FIG. 6 is a schematic view of an arrangement manner of the first group of openings 321 of the first transparent electrode plate 301 in FIG. 1.

In order to achieve the above objectives, an arrangement manner of the first group of openings 321 and the second group of openings 322 according to an embodiment of the present invention is disclosed. FIG. 6 is a schematic view of an arrangement manner of the first group of openings 321 of the first transparent electrode plate 301 in FIG. 1. A first group of virtual straight lines 181 and a second group of virtual straight lines 182 are shown on the surface of the first transparent electrode plate 301. All straight lines in the first group of virtual straight lines 181 are in parallel with each other and distances between any two adjacent straight lines are the same. All the straight lines in the second group of virtual straight lines 182 are in parallel with each other and distances between any two adjacent straight lines are the same. In addition, an angle is formed between the first group of virtual straight lines 181 and the second group of virtual straight lines 182. Preferably, the angle is a right angle. A shape formed by the first group of virtual straight lines 181 and the second group of virtual straight lines 182 is similar to checker lines on a chessboard. The first group of virtual straight lines 181 and the second group of virtual straight lines 182 have a plurality of intersections. In order to avoid the generation of a Moire of relatively low spatial frequency when overlapping the display panel, arrangement positions of the openings 131 are as follows. The central positions of 1/9 of the openings is located at a position where an intersection moves for a distance d in a direction opposite to the D1 direction and moves for a distance d in a D2 direction, for example, a position of a opening 131*a*. The central position of 1/9 of the openings is located at a position where an intersection moves for a distance d in the D2 direction, for example, a position of a opening 131*b*. The central position of 1/9 of the openings is located at a position where an intersection moves for a distance d in a D1 direction and moves for a distance d in the D2 direction, for example, the position of the opening 131*c*. The central position of 1/9 of the openings is located at a position where an intersection moves for a distance d in the direction opposite to the D1 direction, for example, a position of the opening 131*d*. The central position of 1/9 of the opening is located at a position of an intersection, for example, a position of the opening 131*e*. The central position of 1/9 of the openings is located at a position where an intersection moves for a distance d in the D1 direction, for example, a position of the opening 131*f*. The central position of 1/9 of the openings is located at a position where an intersection moves for a distance d in the direction opposite to the D1 direction and moves for a distance d in a direction opposite to the D2 direction, for example, a position of the opening 131*g*. The central position of 1/9 of the openings is located at a position where an intersection moves for a distance d in the direction opposite to the D2 direction, for example, a position of the opening 131*h*. The central position of 1/9 of the openings is located at a position where an intersection moves for a distance d in the D1 direction and moves for a distance d in a direction opposite to the D2 direction, for example, a position of the opening 131*i*. The size of the first group of openings 321 of the first transparent electrode plate 301 needs to be chosen according to the size of the black matrix 82 of the display panel 80. Therefore, in this embodiment, it is assumed that a spatial period $P_X$ of the pixels in the X-axis direction is 80 μm and a spatial period $P_Y$ of the pixels in the Y-axis direction is 240 μm. In such a condition, a distance between each intersection and an adjacent intersection is 160 μm in FIG. 6. The distance d may be 0 μm to 40 μm, and preferably 20 μm. A diameter of each opening is 80 μm. In addition, an angle is formed between the D1 axis in FIG. 6 and the X-axis in the FIG. 4A, which is preferably 20-30 degrees, 60-70 degrees, 110-120 degrees, 150-160 degrees, 200-210 degrees, 240-250 degrees, 290-300 degrees, or 330-340 degrees.

The second group of openings 322 of the second transparent electrode plate 302 is arranged in a similar manner as the first group of openings 321 of the first transparent electrode plate 301. Only an angle between the D1 axis and the X-axis in FIG. 3A is preferably different from that of the first group of openings 321, so as to avoid a Moire between the two groups of openings. For example, the first group of openings 321 uses 30 degrees and the second group of openings 322 uses 330 degrees. The above arrangement is only illustrative, and not intended to limit the present invention. Persons of ordinary skill in the art may design a opening arrangement manner having the same effect according to the spirit of this embodiment.

Figure 7:
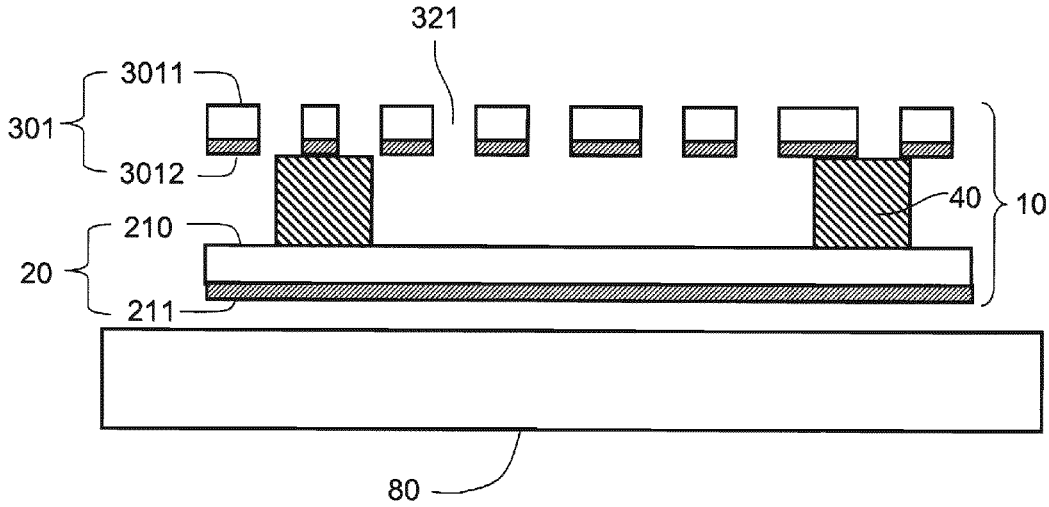
FIG. 7 is a schematic sectional view of a display module integrating a single-layer electrode-plate transparent speaker according to an embodiment of the present invention.

The present invention further provides a display module integrating a transparent speaker. Referring to FIG. 7, the display module comprises a single-layer electrode-plate transparent speaker 10 and a display panel 80. In an embodiment of the present invention, the display panel 80 is a liquid crystal display panel. However, the scope of the present invention is not limited thereto. The display module integrating the transparent speaker comprises a single-layer electrode-plate transparent speaker 10 and a display panel 80. The single-layer electrode-plate transparent speaker 10 is disposed on the display panel 80. A user may watch images displayed on the display panel 80 through the single-layer electrode-plate transparent speaker 10 without being interfered by a Moire.

Figure 8:
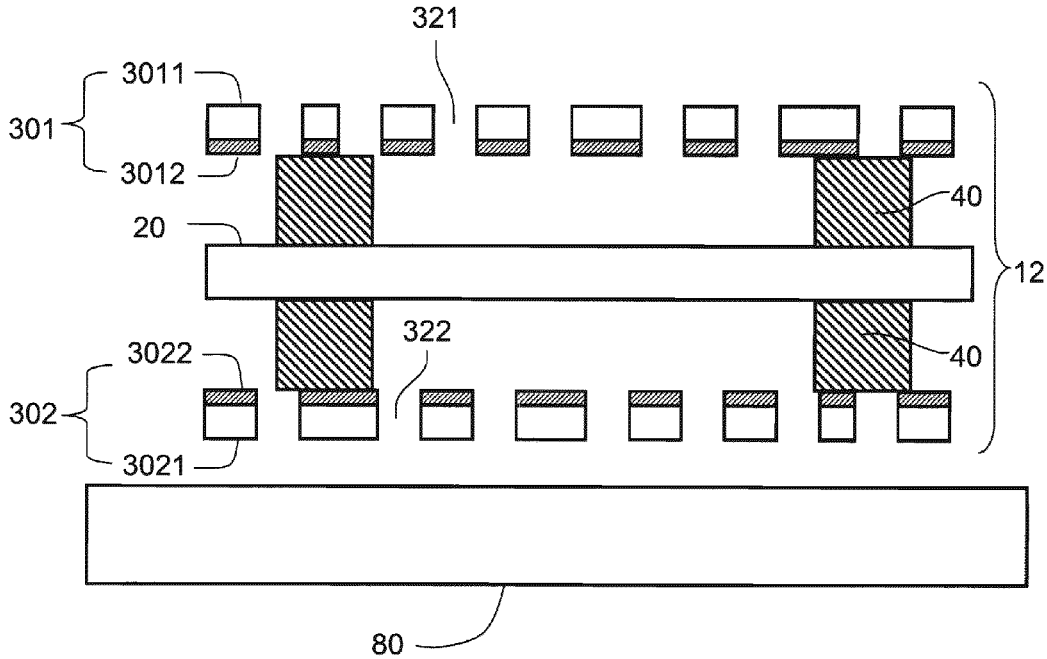
FIG. 8 is a schematic sectional view of a display module integrating a double-layer electrode-plate transparent speaker according to an embodiment of the present invention.

The present invention further provides another display module integrating a transparent speaker. Referring to FIG. 8, the display module comprises a single-layer electrode-plate transparent speaker 10 and a display panel 80. The single-layer electrode-plate transparent speaker 10 is as shown in FIG. 6. The user may watch images displayed on the display panel 80 through the single-layer electrode-plate transparent speaker 10 without being interfered by the Moire.

In order to achieve better sound performance of a speaker, in FIG. 7 and FIG. 8, a preferred embodiment, a gap may be kept between the speaker and the display panel 80. The gap may not only enable sound to be transmitted by effectively utilizing air between the speaker and the display panel 80, but also may avoid interference due to resonance generated between the display panel 80 and the speaker at the same time.

Figure 9:
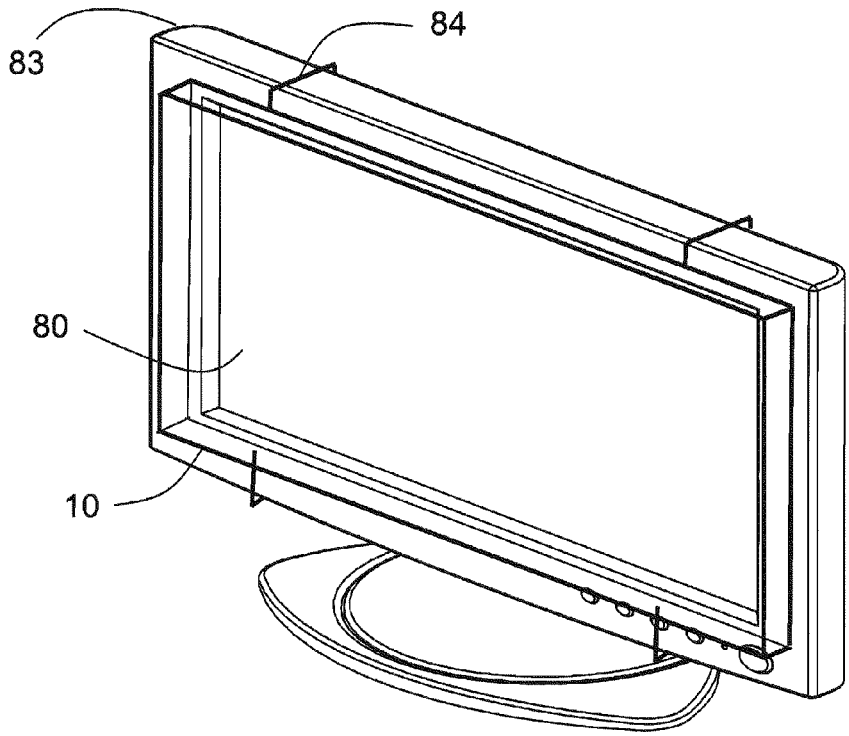
FIG. 9 is a first schematic three-dimensional view of the present invention.
Figure 10:
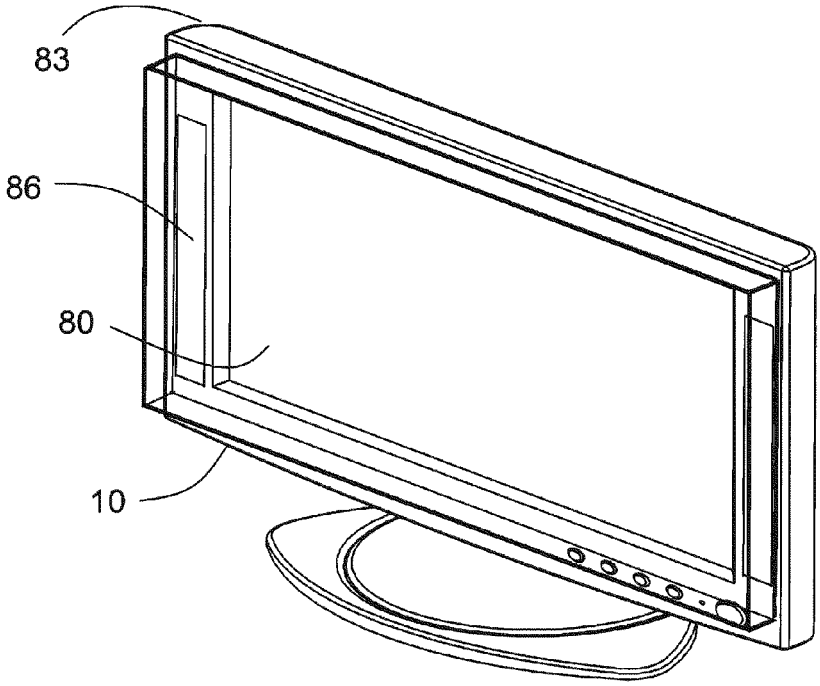
FIG. 10 is a second schematic three-dimensional view of the present invention.

FIGS. 9 and 10 are schematic three-dimensional views according to the present invention. The display panel 80 is disposed in a housing 83. In a preferred embodiment, the display panel 80 and the housing 83 has a height difference spatially. In FIG. 9, fasteners 84 are used to dispose the double-layer electrode-plate transparent speaker 12 on the housing 83. The sound may be transmitted from the gap between the housing 83 and the display panel 80.

In FIG. 10, bonding pieces 86 are used to dispose the double-layer electrode-plate transparent speaker 12 on the housing 83 of the display panel 80. The bonding pieces 86 may be preferably vibration absorbing sponge, or other soft and anti-vibration bonding materials. As the bonding pieces 86 are located between the double-layer electrode-plate transparent speaker 12 and the housing 83, a gap also exists between the single-layer electrode-plate transparent speaker 10 and the display panel 80. A distance of the gap is approximately equal to a thickness of the bonding piece 86. Of course, the above manners for disposing the double-layer electrode-plate transparent speaker 12 on the display panel are not intended to limit the present invention. In other preferred embodiments according to the present invention, persons skilled in the art may also replace the double-layer electrode-plate transparent speaker 12 in FIG. 9 or FIG. 10 with the single-layer electrode-plate transparent speaker 10 shown in FIG. 6.

In conclusion, as the above transparent speaker has openings specially arranged, when the transparent speaker and the display panel overlap each other, a Moire of a low spatial frequency may be avoided, thereby further improving the visual performance of the combination of the transparent speaker and the display panel. In addition, according to the structure of the above display module, as the transparent speaker may be disposed on a display panel of a notebook or a handheld mobile device, room of the notebook or handheld mobile device may be more effectively utilized. In such a manner, a large-size speaker may be disposed on the notebook or handheld mobile device, such that a user may enjoy better sound performance.

What is claimed is:

1. A transparent speaker, adapted for being disposed on a display panel, the transparent speaker comprising:

a transparent electrode plate, each having a plurality of openings and two surfaces opposite to each other, wherein the openings penetrate the transparent electrode plate from the one surface of the transparent electrode plate to the other surface thereof, the transparent electrode plate comprising an electrode body and an electrode conductive layer, the conductive layer is disposed on one surface of the electrode body;

a transparent membrane, comprising a membrane body and a membrane conductive layer, the transparent membrane is disposed between the display panel and the transparent electrode plate; and a plurality of spacers, disposed between the transparent membrane and the transparent electrode plate;

wherein the display panel comprises a plurality of pixels, the pixels emit optical signals, and a Moire spatial period of the optical signals is less than 600 μm after the optical signal penetrates through the transparent speaker.

2. The transparent speaker according to claim 1, wherein the transparent electrode plate has a planar two-dimensional graphic, the planar two-dimensional graphic is a function f described through a rectangular coordinate, the rectangular coordinate comprises an X-axis and a Y-axis perpendicular to each other, a value of the function fat a position of the opening is 0, a value of the function fat a position of the non-opening is 1, the function f is Fourier transformed into a function F, the function F is another function described through another rectangular coordinate, the rectangular coordinate comprises an $S_x$ axis and an $S_y$ axis perpendicular to each other, and for any point $(c_x,c_y)$ located within the $$\left(s_x - m\times\frac{1}{P_X}\right)^2 + \left(s_Y - n\times\frac{1}{P_Y}\right)^2 < \left(\frac{1}{600um}\right)^2 \text{ and}$$

$$|s_x| > \frac{1}{W_x},\quad |s_Y| > \frac{1}{W_Y},$$

the Fourier transformed function F has to satisfy the following expression:

$$\frac{\int_{c_X-\frac{1}{2W_X}}^{c_X+\frac{1}{2W_X}}\int_{c_Y-\frac{1}{2W_Y}}^{c_Y+\frac{1}{2W_Y}}|F(s_x,s_y)|^2 ds_x ds_Y}{\int_{-\infty}^{\infty}\int_{-\infty}^{\infty}|F(s_x,s_y)|^2 ds_x ds_Y} < 0.01$$

wherein the $W_X$ and the $W_Y$ are lengths of the planar two-dimensional graphic on the X-axis and the Y-axis, the m and n are either −1, 0 or 1, the $P_X$ are spatial periods of the plurality of pixels of the display panel on the X-axis, and the $P_Y$ are spatial periods of the plurality of pixels of the display panel on the Y-axis.

3. The transparent speaker according to claim 1, wherein the transparent membrane is located between the display panel and the membrane body.

4. The transparent speaker according to claim 1, wherein the transparent membrane is a transparent electret membrane.

5. The transparent speaker according to claim 1, wherein the transparent conductive layer is made of aluminum zinc oxide (AZO) or indium tin oxide (ITO).

6. A transparent speaker, adapted for being disposed on a display panel, the transparent speaker comprising:

a first transparent electrode plate, each having a plurality of first openings and two surfaces opposite to each other, wherein the first openings penetrate the first transparent electrode plate from the one surface of the first transparent electrode plate to the other surface thereof, the first transparent electrode plate comprising a first electrode body and a first electrode conductive layer, the first conductive layer is disposed on one surface of the first electrode body;

a transparent membrane, the transparent membrane is disposed between the display panel and the first transparent electrode plate;

a second transparent electrode plate, each having a plurality of second openings and two surfaces opposite to each other, wherein the second openings penetrate the second transparent electrode plate from the one surface of the second transparent electrode plate to the other surface thereof, the second transparent electrode plate comprising a second electrode body and a second electrode conductive layer, the second conductive layer is disposed on one surface of the second electrode body, the second transparent electrode plate is located between the transparent membrane and the display panel;

wherein the display panel comprises a plurality of pixels, the pixels emit optical signals, and a Moire spatial period of the optical signals is less than 600 μm an after the optical signal penetrates through the transparent speaker.

7. The transparent speaker according to claim 6, wherein the transparent electrode plate has a planar two-dimensional graphic, the planar two-dimensional graphic is a function f described through a rectangular coordinate, the rectangular coordinate comprises an X-axis and a Y-axis perpendicular to each other, a value of the function fat a position of the first or second opening is 0, a value of the function fat a position of the non-first or non-second opening is 1, the function f is Fourier transformed into a function F, the function F is another function described through another rectangular coordinate, the rectangular coordinate comprises an $S_x$ axis and an $S_y$ axis perpendicular to each other, and for any point $(c_x,c_y)$ located within $$\left(s_x - m\times\frac{1}{P_X}\right)^2 + \left(s_Y - n\times\frac{1}{P_Y}\right)^2 < \left(\frac{1}{600um}\right)^2 \text{ and}$$

$$|s_x| > \frac{1}{W_x},\quad |s_Y| > \frac{1}{W_Y},$$

the Fourier transformed function F has to satisfy the following expression:

$$\frac{\int_{c_X-\frac{1}{2W_X}}^{c_X+\frac{1}{2W_X}}\int_{c_Y-\frac{1}{2W_Y}}^{c_Y+\frac{1}{2W_Y}}|F(s_x,s_y)|^2 ds_x ds_Y}{\int_{-\infty}^{\infty}\int_{-\infty}^{\infty}|F(s_x,s_y)|^2 ds_x ds_Y} < 0.01$$

wherein the $W_X$ and the $W_Y$ are lengths of the planar two-dimensional graphic on the X-axis and the Y-axis, the m and n are either −1, 0 or 1, the $P_X$ are spatial periods of the plurality of pixels of the display panel on the X-axis, and the $P_Y$ are spatial periods of the plurality of pixels of the display panel on the Y-axis.

8. The transparent speaker according to claim 6, wherein the transparent membrane is a transparent electret membrane.

9. The transparent speaker according to claim 6, wherein the transparent conductive layer is made of aluminum zinc oxide (AZO) or indium tin oxide (ITO).

10. A display module with a transparent speaker, comprising:

a transparent speaker, comprising:

a transparent electrode plate, each having a plurality of openings and two surfaces opposite to each other, wherein the openings penetrate the transparent electrode plate from the one surface of the transparent electrode plate to the other surface thereof, the transparent electrode plate comprising an electrode body and an electrode conductive layer, the conductive layer is disposed on one surface of the electrode body;

a transparent membrane, comprising a membrane body and a membrane conductive layer; and a plurality of spacers, disposed between the transparent membrane and the transparent electrode plate; and a display panel, overlapping the transparent speaker;

wherein the transparent membrane is disposed between the display panel and the transparent electrode plate, the display panel comprises a plurality of pixels, the pixels emit optical signals, and a Moire spatial period of the optical signals is less than 600 μm after the optical signal penetrates through the transparent speaker.

11. The display module according to claim 10, wherein the transparent electrode plate has a planar two-dimensional graphic, the planar two-dimensional graphic is a function f described through a rectangular coordinate, the rectangular coordinate comprises an X-axis and a Y-axis perpendicular to each other, a value of the function fat a position of the opening is 0, a value of the function fat a position of the non-opening is 1, the function f is Fourier transformed into a function F, the function F is a function described through another rectangular coordinate, the rectangular coordinate comprises an $S_x$ axis and an $S_y$ axis perpendicular to each other, and for any point $(c_x,c_y)$ located within the $$\left(s_x - m\times\frac{1}{P_X}\right)^2 + \left(s_Y - n\times\frac{1}{P_Y}\right)^2 < \left(\frac{1}{600um}\right)^2 \text{ and}$$

$$|s_x| > \frac{1}{W_x},\quad |s_Y| > \frac{1}{W_Y},$$

function F after Fourier transform has to satisfy the following expression:

$$\frac{\int_{c_X-\frac{1}{2W_X}}^{c_X+\frac{1}{2W_X}}\int_{c_Y-\frac{1}{2W_Y}}^{c_Y+\frac{1}{2W_Y}}|F(s_x,s_y)|^2 ds_x ds_Y}{\int_{-\infty}^{\infty}\int_{-\infty}^{\infty}|F(s_x,s_y)|^2 ds_x ds_Y} < 0.01$$

wherein the $W_X$ and the $W_Y$ are lengths of the planar two-dimensional graphic on the X-axis and the Y-axis, the m and n are either −1, 0 or 1, the $P_X$ are spatial periods of the plurality of pixels of the display panel on the X-axis, and the $P_Y$ are spatial periods of the plurality of pixels of the display panel on the Y-axis.

12. The display module according to claim 11, wherein the transparent membrane is located between the display panel and the membrane body.

13. The display module according to claim 11, wherein the transparent membrane is a transparent electret membrane.

14. The display module according to claim 11, wherein the transparent conductive layer is made of aluminum zinc oxide (AZO) or indium tin oxide (ITO).

15. A display module with a transparent speaker, comprising:

a transparent speaker, comprising:

a first transparent electrode plate, each having a plurality of first openings and two surfaces opposite to each other, wherein the first openings penetrate the first transparent electrode plate from the one surface of the first transparent electrode plate to the other surface thereof, the first transparent electrode plate comprising a first electrode body and a first electrode conductive layer, the first conductive layer is disposed on one surface of the first electrode body;

a transparent membrane, the transparent membrane is disposed between the display panel and the first transparent electrode plate;

a second transparent electrode plate, each having a plurality of second openings and two surfaces opposite to each other, wherein the second openings penetrate the second transparent electrode plate from the one surface of the second transparent electrode plate to the other surface thereof, the second transparent electrode plate comprising a second electrode body and a second electrode conductive layer, the second conductive layer is disposed on one surface of the second electrode body, the second transparent electrode plate is located between the transparent membrane and the display panel; and a display panel, overlapping the transparent speaker;

wherein the display panel comprises a plurality of pixels, the pixels emit optical signals, and a Moire spatial period of the optical signals is less than 600 μm after the optical signal penetrates through the transparent speaker.

16. The display module according to claim 15, wherein the transparent electrode plate has a planar two-dimensional graphic, the planar two-dimensional graphic is a function f described through a rectangular coordinate, the rectangular coordinate comprises an X-axis and a Y-axis perpendicular to each other, a value of the function fat a position of the first or second opening is 0, a value of the function fat a position of the non-first or non-second opening is 1, the function f is Fourier transformed into a function F, the function F is another function described through another rectangular coordinate, the rectangular coordinate comprises an $S_x$ axis and an $S_y$ axis perpendicular to each other, and for any point $(c_x,c_y)$ located within $$\left(s_x - m\times\frac{1}{P_X}\right)^2 + \left(s_Y - n\times\frac{1}{P_Y}\right)^2 < \left(\frac{1}{600um}\right)^2 \text{ and}$$

$$|s_x| > \frac{1}{W_x},\quad |s_Y| > \frac{1}{W_Y},$$

the Fourier transformed function F has to satisfy the following expression:

$$\frac{\int_{c_X-\frac{1}{2W_X}}^{c_X+\frac{1}{2W_X}}\int_{c_Y-\frac{1}{2W_Y}}^{c_Y+\frac{1}{2W_Y}}|F(s_x,s_y)|^2 ds_x ds_Y}{\int_{-\infty}^{\infty}\int_{-\infty}^{\infty}|F(s_x,s_y)|^2 ds_x ds_Y} < 0.01$$

wherein the $W_X$ and the $W_Y$ are lengths of the planar two-dimensional graphic on the X-axis and the Y-axis, the m and n are either −1, 0 or 1, the $P_X$ are spatial periods of the plurality of pixels of the display panel on the X-axis, and the $P_Y$ are spatial periods of the plurality of pixels of the display panel on the Y-axis.

17. The display module according to claim 16, wherein the transparent membrane is a transparent electret membrane.

18. The display module according to claim 16, wherein the transparent conductive layer is made of aluminum zinc oxide (AZO) or indium tin oxide (ITO).

* * * * *